United States Patent [19]

Oh

[11] Patent Number: 4,884,585

[45] Date of Patent: Dec. 5, 1989

[54] ROTARY SPRAYER FOR AN AUTOMATIC DISHWASHER

[76] Inventor: Yang H. Oh, 257-6, Naigwang-ri, Bongnam-myon, Kimjei-gun, Chonbuk, Rep. of Korea

[21] Appl. No.: 260,616

[22] Filed: Oct. 21, 1988

[51] Int. Cl.[4] ..... A47L 15/23

[52] U.S. Cl. ..... 134/176; 134/178; 134/179; 239/255

[58] Field of Search ..... 134/176, 178, 179; 239/255, 256, 257, 258

[56] References Cited

U.S. PATENT DOCUMENTS

| | | | |
|---|---|---|---|
| 2,918,927 | 12/1959 | Clearman | 134/176 X |
| 3,261,554 | 7/1966 | Perl | 239/256 X |
| 3,362,645 | 1/1968 | Clark | 239/258 |
| 3,797,509 | 3/1974 | Fukuzawa et al. | 134/179 X |
| 4,175,575 | 11/1979 | Cushing | 134/180 X |
| 4,210,285 | 7/1980 | Dicken, Jr., et al. | 239/251 |
| 4,418,868 | 12/1983 | Gurubatham et al. | 239/228 |

*Primary Examiner*—Philip R. Coe

*Attorney, Agent, or Firm*—Birch, Stewart, Kolasch & Birch

[57] ABSTRACT

An improved rotary sprayer for an automatic dishwasher includes a pair of elongated hollow arms containing a plurality of nozzles and a pair of end nozzles for periodically and alternately opening and closing, respectively by rotation of rotation converting valve which is, in turn, driven by valve driving member whereby dishes held in the dish racks is uniformly cleaned by spraying the surface of the dishes with the cleaning water by the nozzles.

5 Claims, 4 Drawing Sheets

A
A
B
B
10
10a
20
20a
24
24a
30
31
32
32a
34
35
40
41
60
61
61a
62
63
64
65
66
67
68
69
70
71
72
73
80
81
81a
82
83
84
84a
85
90
91
92
100

94
96
35
34
95
30
D
D
32
31
82
60
61
62
63
64
65
66
67
68
69
70
71
24
24a
20
20a
10
10a
100
40
41
61a
72
73
81
81a
80
84
84a
85
83
C
C
90

ROTARY SPRAYER FOR AN AUTOMATIC DISHWASHER

BACKGROUND OF THE INVENTION

1. Field of the Invention

The present invention relates to a rotary sprayer for an automatic dishwasher and particularly, to a rotary sprayer rotating and reverse rotating periodically so that the rotary sprayer sprays uniformly cleaning water over the whole surface of dishes and food containers to be cleaned.

2. Description of the Prior Art

There are many types of rotary sprayers for an automatic dishwasher which are well known in the prior art which are disposed under dish racks and spray pressured cleaning water upwardly. Such rotary sprayers cannot uniformly spray the cleaning water whole surface of dishes to be cleaned.

U.S. Pat. Nos. 3,362,645, 4,210,285, and 4,418,868 disclose such rotary sprayers for a dishwasher. Such rotary sprayers of the patents rotate only in one direction. Therefore, the pressured cleaning water are sprayed upwardly and obliquely toward the rear direction in respect of the rotation direction. Accordingly, it is difficult to perform a uniform spray of the cleaning water over the whole surface of the dishes and food containers in the dishwasher to be cleaned. Particularly, deep-drawn food containers such as cups and oriental style bowls cannot be effectively cleaned by such rotary sprayers.

SUMMARY OF THE INVENTION

Accordingly, it is an object of the present invention to provide an improved rotary sprayer for an automatic dishwasher in which the cleaning water is uniformly sprayed by periodically rotating in one direction and in the reverse direction of the rotary sprayer.

Another object of the present invention is to provide a rotary sprayer for an automatic dishwasher which is provided with a pair of elongated hollow arms which extend horizontally and contain a plurality of nozzles formed along the top portion thereof at the predetermined intervals. When the cleaning water is introduced through an inlet and sprayed out upwardly through the nozzles, the arms is rotated due to the reaction forces of the pressured spraying of the cleaning water.

A further objection of the present invention is to provide a rotary sprayer which is structured with a pair of end nozzles for rotating and reverse rotating, rotation converting valves for opening and closing the end nozzles alternately, and a cylindrical housing containing valve driving means which is toggled every certain number of the rotation of the housing for driving the rotation converting valves at certain intervals causing the rotary sprayer to spray periodically and reversibly.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a rotary spry for an automatic dishwasher which comprises a pair of elongated hollow arms having a plurality of nozzles and a pair of end nozzles and a pair of valves for opening and closing the pair of end nozzles alternately, and a cylindrical housing containing driving valve means for periodical and reverse spray thereof whereby the dishes held in the automatic dishwasher having the rotary sprayer is effectively cleaned.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
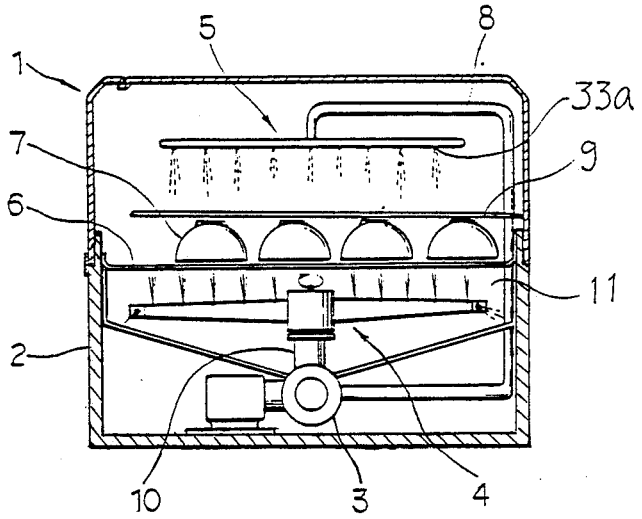
FIG. 1 is a sectional view of the automatic dishwasher according to the present invention.
Figure 2:
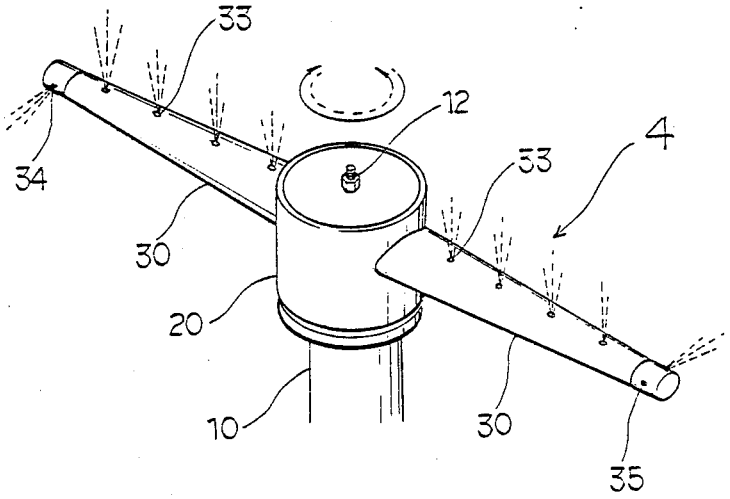
FIG. 2 is a perspective view of a rotary sprayer according to the present invention.

Referring now in detail to the drawings for the purpose of illustrating preferred embodiments of the present invention, the dishwasher 1 having an improved rotary sprayer as shown in FIGS. 1 and 2 comprises a cabinet 2 including a front opening door (not shown) and an interior washing cavity 11 which contains a center dish rack 6 and an upper dish rack 9 disposed in the interior washing cavity 11. The cabinet 2 contains a rotary spray member 4 disposed under the middle dish rack 6 and a fixed spray member 5 disposed over the upper dish rack 5. The rotary and fixed spray members 4 and 5 connect a motor and pump 3 through a connecting tube 10 and a water pipe 8, respectively. The fixed spray member 5 has a plurality of nozzles 33*a* for downwardly spraying the pressured cleaning water from the water pipe 8 onto the outside surface of dishes 7 held in the dish racks 6 and 9. The rotary spray member 4 includes a cylindrical housing 20 and a pair of elongated hollow arms 30 extended from the cylindrical housing 20 in the opposite directions (FIG. 2). The elongated hollow arm 30 have a plurality of nozzles 33 disposed at the top portion thereof for upwardly spraying the water from the connecting tube 10 into the inside surface of the dishes 7 held in the dish racks 6 and 9. The elongated hollow arms 30 also have a pair of end nozzles 34 and 35 disposed at the end portions thereof in the opposite direction, respectively. The rotary spray member 4 is rotated and reversibly rotate about a supporting shaft member 12.

As shown in FIGS. 3–7, the rotary spray member 4 includes the cylindrical housing 20 containing an outlet 10*a* of the connecting tube 10 which is inserted into a bottom wall 21 of the cylindrical housing 20 and an annular inlet 20*a* disposed around the connecting tube 10 so that the cleaning water is introduced into and drained from the cylindrical housing 20. The cylindrical housing 20 has a side wall 22, and the side wall 22 is provided with a housing outlet 20*b* for supplying the pressurized cleaning water into hollow spaces 31 of the elongated hollow arms 30. The top wall 23 is secured to the top of the side wall 22 and also provided with a shaft hole 23*a* so that the top wall 23 is adapted to engage with tip portions of the supporting shaft member 12 and is supported on an annular step 14 disposed at the upper end of a threaded supporting portion 13 of the supporting shaft member 12. The supporting shaft member 12 is fixedly projected from the center of the outlet 10*a* of the connecting tube 10.

A valve driving means 100 disposed in the cylindrical housing 20 includes a spiral movement means 40 which is threadably engaged with the threaded supporting portion 13 of the supporting shaft member 12 for performing up and down movements through the rotation together with the hosing 20, a lever means 60 which is installed on an inner wall of the housing 20 by means of a shaft for transmitting the rotation of the housing 20 to the spiral movement means 40 and which is toggled up and down in correspondence with the up and down movements of the spiral movement means 40, and a crank means 80 which is rotated by the lever means 60 and which extends through the hollow space 31 of the arms 30 connected to a crank arm 81 within the cylindrical housing 20. The spiral movement means 40 is provided with a pair of fixed pins 41 disposed at a predetermined distance from each other. The lever means 60 contains a U-shaped first lever 61 and a second lever 71. The revolving motion of the housing 20 is transmitted to the spiral movement means 40 by means of the first lever 61. Thus, as the spiral movement means 40 moves up and down, the first lever 61 is toggled. Therefore, the second lever 71 causes to rotate the crank shaft 82. The first lever 61 is connected by means of a pin shaft 63 to a supporting beam 62 which is fixedly attached to the inner surface of the housing wall. The U-shaped first lever 61 slidably moves up and down between the stopper pins 41. The first lever 61 is also provided with a projecting rod 64 which extends from the pin shaft 63 in the opposite direction.

A pair of arms 65 longitudinally extending from the tip of the projecting rod 64 form a yoke to which an elongated rod 67 is connected. The rod 67 is accommodated within a rectangular space 24*a* of outwardly extending portion 24 which is outwardly extended from the side wall 22 of the housing 20 and which is pivotally mounted to the outwardly extended portion 24 by a pivot pin 68. The elongated rod 67 accommodates a compression spring 69 which is positioned in an internal, axially extending bore which opens onto the end adjacent to the projecting rod 64. The rod 67 has a longitudinally and diametrically extending slot 70 adjacent to the same end that intersects the bore. A pivot pin 66 is positioned in the slot 70 so that the compression spring 69 biases the pivot pin toward the end of the elongated rod 67. The pivot pin 66 extends beyond the sides of the rod 67 and into mutually aligned openings in the yoke formed with arms 65 on the projecting rod 64. Thus the projecting rod 64 is pivotally coupled to the elongated rod 67 by the pivot pin 66 so that the first lever 61 is made to be toggled up and down. One end of the U-shaped arm portion of the first lever 61 is provided with a pin 61*a* for moving the second lever 71. The pin 61*a* is inserted into a long slot 72 which is formed at an intermediate position of the second lever 71 which is in turn connected to the supporting beam 62 by means of the pin shaft 63. An U-shaped arm 73 is disposed at the tip of the second lever 71 which is moved by the first lever 61 and a crank arm 81 is inserted into the U-shaped arm 73. The long slot 72 of the second lever 71 contributes to increasing the rotational angle of the crank arm 81.

Crank means 80 moved by the lever means 60 includes a crank shaft 82 which is disposed within the hollow spaces 31 of the hollow arms 30 between the shaft hole 32*a* of a cover 32 and a supporting block 83. The cover 32 is threadably coupled to the outer of the hollow arms 30 and the supporting block 83 is located at the outlet 20*b* of the housing 20. The crank means 80 also includes left and right arcuate crank arms 81 which are respectively connected to the respective left and right crank shaft 82. The left and right crank arms 81 are connected with each other by means of a ring 8!a which is formed at the tip of the right crank arm 8!. The crank means includes a crank rod 84 which is kept perpendicularly to the crank arms is secured to one end of the left crank shaft 82. A tension spring 85 is disposed between a pin 84*a* of the crank rod 84 and the bottom wall 21 of the housing 20.

Therefore, the crank arms 81 are moved up and down by means of the second lever 71. As soon as the crank arms 81 pass over the center, the crank rod 84 is pulled down by the tension spring 85, thereby making it toggle to the left and right. Accordingly, the crank shaft 82 rotates and reversibly rotates within the range of a certain angle. A rotation converting valve means 90 for providing the revolutions is disposed within the hollow spaces 31 where the end nozzles 34 and 35 are oppositely located at the end of the hollow arms 30. The valve means 90 is fixedly secured to the crank shaft 82.

Figures 3, 4, 5:
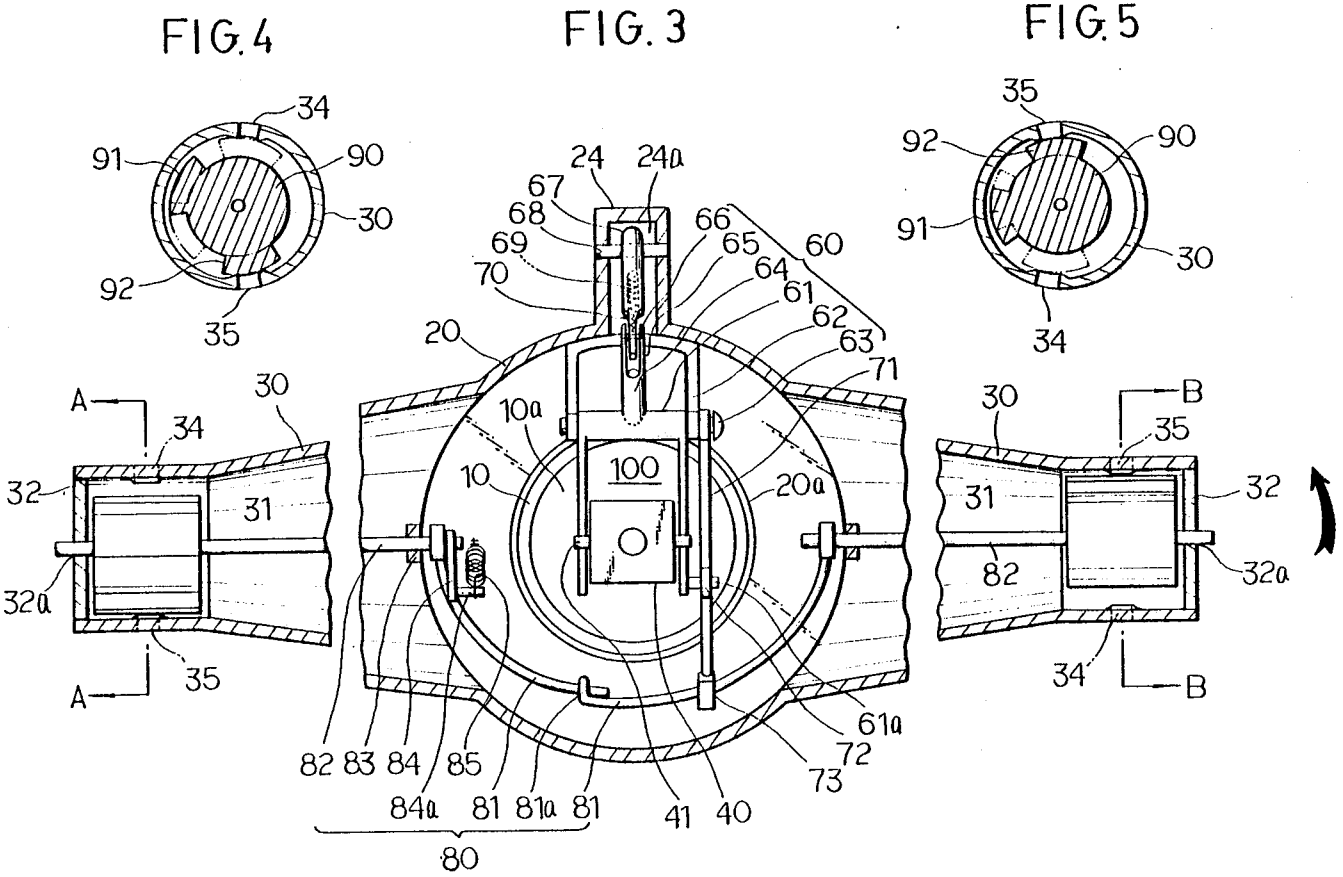
FIG. 3 is a cross-sectional view of FIG. 2.
FIG. 4 is a cross-sectional view of FIG. 3, taken along the line A—A.
FIG. 5 is a cross-sectional view of FIG. 3, taken along the line B—B.

As shown in FIGS. 4 and 5, the valve 90 is provided with a pair of extending portions 91 and 92. The extending portions 91 and 92 respectively open or close the end nozzles 34 and 35.

The inner edges of the end nozzles 34 and 35 proximal to the valve 90 are slightly extended so that a clearance is provided between the curved surfaces of the extending portions 91 and 92 and the inner surface of the arms 30.

Figures 8, 9, 10:
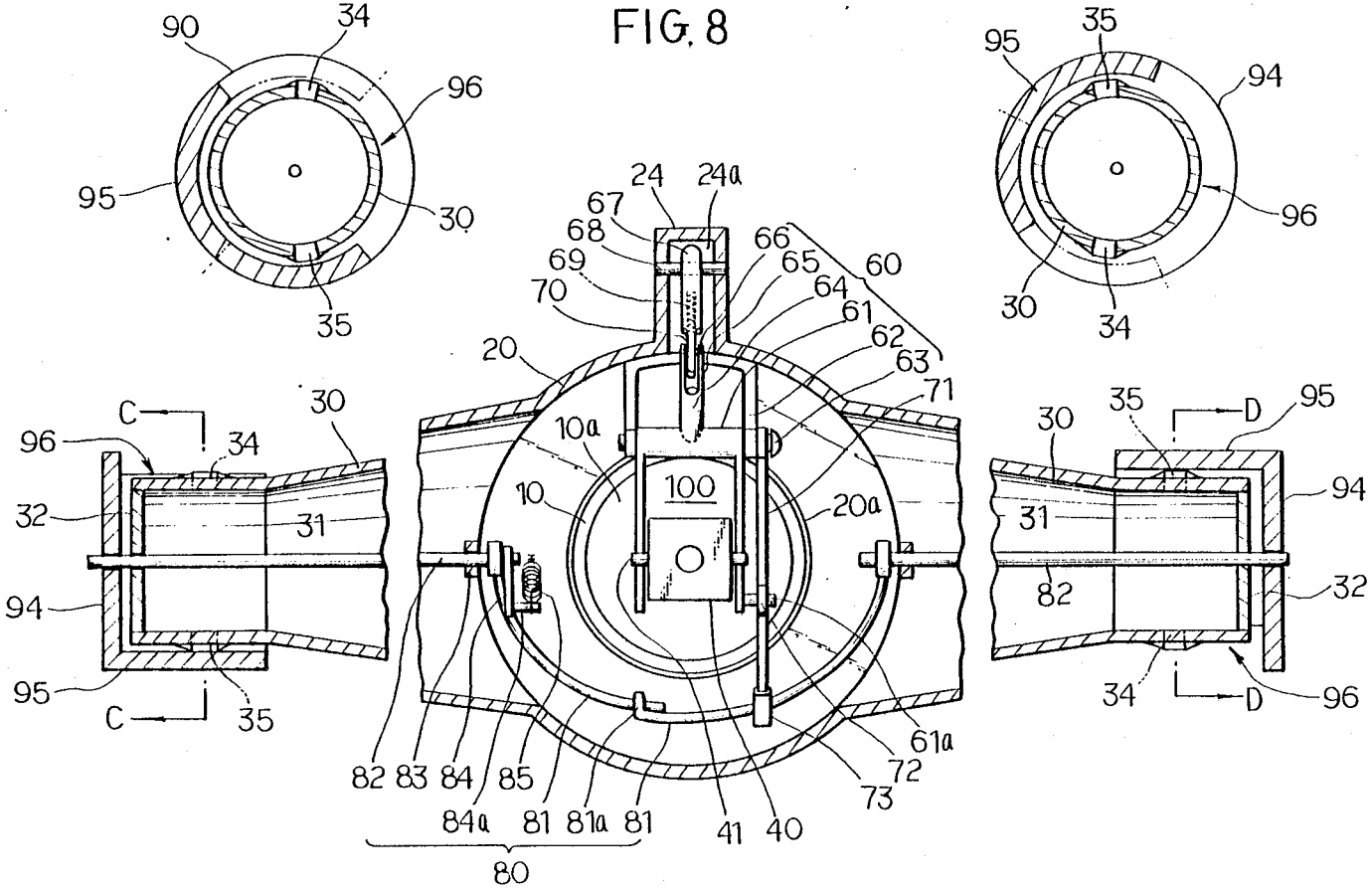
FIG. 8 is a cross-sectional view of another embodiment of the rotary sprayer having an improved valve structure according to the present invention.
FIG. 9 is a cross-sectional view of FIG. 8, taken along the line C—C.
FIG. 10 is a cross-sectional view of FIG. 8, taken along the line D—D.
Figure 6:
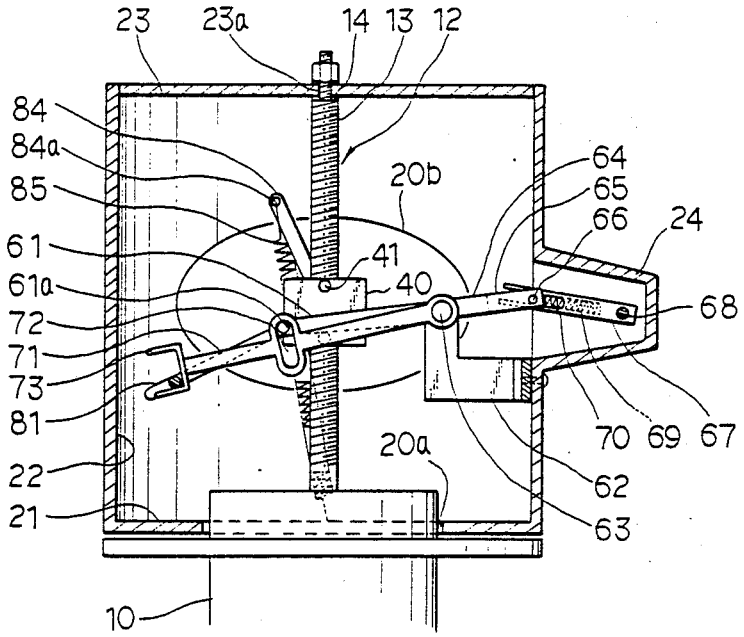
FIG. 6 is a sectional view of a cylindrical housing of a rotary sprayer according to the present invention.

Another embodiment of the rotary sprayer having an improved valve according to the present invention is provided as shown in FIGS. 8, 9, and 10. The improved valve has a cylinder configuration and disposed at a side wall thereof. The improved valve is fixedly secured to the crank shaft 82 which is protruded outwardly of the cover 32 of the elongated hollow arms 30. The valve receives the end portion of the hollow arms 30 wherein the end nozzles 34 and 35 are located therein. The opening 96 of the side wall 95 is operated for opening and closing the end nozzles 34 and 35. The outside edges of the end nozzles 34 and 35 are slightly projected.

Figure 7:
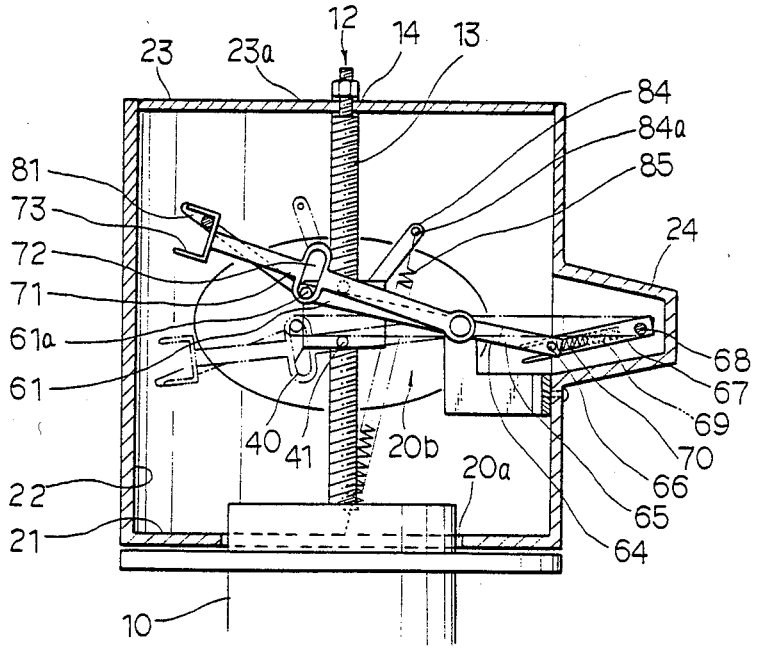
FIG. 7 is a vertical cross-sectional view of a cylindrical housing of the rotary sprayer illustrating its actuation.

In operation, when the rotary spray member 4 rotates in the forward direction (FIG. 6), the spiral movement means 40 performs spiral movements and simultaneously moves slowly upward. Accordingly, the U-shaped arm of the first lever 61 moves upward due to the action of the pin 41 and simultaneously the second lever 71 received the pin 61*a* of the U-shaped arm in the long slot 72 thereof moves also upward, thereby rotating upwardly the crank arm 81 which is rotatably secured to the tip of the U-shaped arm 73. The first lever 61 passes over the horizontal position thereof during its moving and the projected rod 64 is rotatably pushed down around the pin shaft 63 due to the action of the compression spring 69. Accordingly, the first lever 61 rotates up to the upper pin 41 of the spiral movement means 40 for pulling the second lever 71 in the upward direction. The crank arm 81 passes over the horizontal position by the action of the second lever 71 and the crank rod 84 secured to the crank shaft integrally with the crank arm 81 rotates rightwardly due to the action of the tension spring 85 until it is stopped by the pin 61*a* of the first lever 61, as shown in FIG. 7. Accordingly, the valve 90 of the left arm 30 is rotated by the crank shaft 82 for closing the end nozzle 34, and to open the other end nozzle 35 as shown by the dotted lines in FIGS. 4 and 9. Similarly, the position of the valve 90 of the right arm 30 is shifted as shown by the dotted lines in FIGS. 5 and 10.

Thus the pressurized water is forcefully sprayed and the reaction force of the spray through the other end nozzles 35 makes the elongated hollow arms 30 rotate the reverse direction. During such reverse rotation of the hollow arms 30, the spiral movement means 40 moves downward. The first lever 61 is simultaneously pulled downwardly by the upper pin 41 of the spiral movement means 40. Accordingly, the first lever 61 causes the second lever 71 rotate downwardly. The second lever 71 in turn causes the crank arm 81 rotate downwardly. The crank rod 84 is simultaneously rotated leftwardly. The first lever 61 passes over the horizontal position downwardly during the reverse rotation and the projected rod 64 is pushed upward contrary to the situation of the rotation. The U-shaped arm is caused to rotate downwardly until it reaches the lower pin 41 of the spiral movement means 40 and to pull the second lever 71 simultaneously. The crank arm 81 is rotated downwardly by the action of the second lever 71 and the crank arm 81 passes over the horizontal position simultaneously. The crank rod 84 passes over the vertical position from the right to the left and the crank rod 84 speedily rotates leftwardly due to the action of the tension spring 85.

Accordingly, the valve 90 is shifted to the position of FIGS. 4 and 5 or FIGS. 9 and 10 in which the other end nozzle 35 is closed and the end nozzle 34 is open so that the pressure cleaning water is discharged through the end nozzle 34. The first lever 61 is toggled to the up and down movements of the spiral movement means 40. Thus the toggled first lever 61 causes the second lever 71 to rotate so that the crank arm 81 is toggled up and down for forwardly and reversibly rotating the valve 90 fixedly secured to the crank shaft 82, thereby opening and closing the end nozzles 34 and 35 alternately. Accordingly, the spraying direction of &:he cleaning water from the end nozzles 34 and 35 is periodically reversed, thereby causing the periodical reverse of the rotation direction of the rotary spray member 4.

Therefore, regardless of the deflection of the sprayed water due to the rotation of the rotary spray member 4, the cleaning water is uniformly sprayed to the inside and outside of the dishes so that the dishes is effectively cleaned.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A rotary sprayer for an automatic dishwasher which comprises:

a dishwasher cabinet having a front opening door mounted thereto, said dishwasher cabinet defining an interior washing cavity, at least one dish rack supported at a middle portion of said interior washing cavity, a fixed spray member disposed above said dish rack, said fixed spray member including a substantially horizontal, elongated tube containing a plurality of nozzles disposed at the bottom of said horizontal tube for spraying water onto the dishes held by said dish rack, a motor and pump connected to said horizontal tube for pumping water therethrough, and a rotary spray member disposed below said dish rack in the lower portion of the washing cavity, said rotary spray member including:

a pair of elongated hollow arms each having a plurality of top nozzles disposed on a top portion thereof, a pair of end nozzles facing in opposite directions and disposed at a front and a rear side wall of an end portion of said pair of elongated hollow arms, respectively, whereby said top nozzles direct water to said dishes held by said dish rack and the pair of end nozzles function to create a driving force for rotating said rotary sprayer member, a pair of rotation converting valves for alternately opening and closing said end nozzles, and a cylindrical housing connected to said pair of elongated hollow arms, said cylindrical housing containing:

an inlet and outlet for introducing and draining water therethrough, respectively, and valve driving means toggled for driving said pair of rotation converting valves so that the rotary spray member periodically reverses its rotating direction, whereby the dishes held by the dish rack are uniformly cleaned by spraying the surface of the dishes with said fixed and rotary spray members.

2. The rotary sprayer of claim 1, wherein the valve driving means includes:

a spiral movement means for spirally moving up and down along a shaft rotating together with said cylindrical housing, lever means pivotably attached to an inner surface of an outwardly extending portion of a wall of said cylindrical housing to pivotably move up and down for transmitting rotation of said cylindrical housing to said spiral movement means and toggled up and down in correspondence with the up and down movements of said spiral movement means, and crank means associated with one of end of a crank arm disposed within said cylindrical housing wherein the other end of the crank arm is connected to said lever means, said crank means disposed within a pair of hollow spaces of said elongated hollow arms and having said pair of rotation converting valves, respectively.

3. The rotary sprayer of claim 2, wherein each rotation converting valve is provided with a pair of extending portions extending radially with a certain angle therebetween.

4. The rotary sprayer of claim 2, wherein each rotation converting valve is fixedly attached to a crank shaft of said crank means, wherein the crank shaft extends outwardly of a cover of said elongated hollow arms for alternately opening and closing the pair of end nozzles disposed at the front and rear side wall of the end portion of the elongated arms, in correspondence with a rotation or a reverse rotation of the crank shaft.

5. The rotary sprayer of claim 4, the crank means further includes:

a crank rod fixedly attached to said crank shaft and kept in a perpendicular angle to said crank arm, and a tension spring disposed between a pin of the crank rod and the bottom wall of said cylindrical housing so that the crank rod is toggled to a rotating position or a reverse rotating position.

* * * * *